US009682420B2

(12) United States Patent
Choda et al.

(10) Patent No.: US 9,682,420 B2
(45) Date of Patent: Jun. 20, 2017

(54) FORGING DIE DEVICE

(71) Applicant: Kobe Steel, Ltd., Hyogo (JP)

(72) Inventors: Takashi Choda, Kobe (JP); Yukihide Honda, Kobe (JP); Shigeomi Araki, Takasago (JP); Shogo Murakami, Kobe (JP); Soichiro Kojima, Takasago (JP); Yusuke Momota, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/375,958

(22) PCT Filed: Mar. 27, 2013

(86) PCT No.: PCT/JP2013/058920

§ 371 (c)(1),
(2) Date: Jul. 31, 2014

(87) PCT Pub. No.: WO2013/146844

PCT Pub. Date: Oct. 3, 2013

(65) Prior Publication Data

US 2015/0052962 A1 Feb. 26, 2015

(30) Foreign Application Priority Data

Mar. 28, 2012 (JP) ..... 2012-073850

(51) Int. Cl.
*B21K 29/00* (2006.01)
*B21J 13/02* (2006.01)
(Continued)

(52) U.S. Cl.
CPC ..... *B21K 29/00* (2013.01); *B21J 1/06* (2013.01); *B21J 13/02* (2013.01); *B21J 13/03* (2013.01); *B21J 13/085* (2013.01)

(58) Field of Classification Search
CPC ... B21K 29/00; B21J 1/06; B21J 5/025; B21J 9/02; B21J 9/08; B21J 13/02; B21J 13/03; B21J 17/00; B21J 17/02; B21J 13/085
(Continued)

(56) References Cited

U.S. PATENT DOCUMENTS 4,265,105 A 5/1981 MacNitt, Jr. et al.
2003/0056562 A1 3/2003 Kamano et al.
(Continued)

FOREIGN PATENT DOCUMENTS

JP H01-113145 A 5/1989
JP 03077741 A * 4/1991
(Continued)

OTHER PUBLICATIONS

EPO Machine Translation of JP 2001-225139.*
(Continued)

*Primary Examiner* — Peter DungBa Vo
*Assistant Examiner* — Joshua D Anderson
(74) *Attorney, Agent, or Firm* — Studebaker & Brackett PC

(57) ABSTRACT

A forging die device is provided with an upper die 10 and a lower die 20. At least one die 10 (20) of the upper die 10 and the lower die 20 has a die holder 12 (22) which surrounds the outer periphery of the die 10 (20) and holds the die 10 (20). The die holder 12 (22) is configured to bear the radial tensile stress (tensile force) received by the die 10 (20) during forging. By this means, the die 10 (20) can be miniaturized.

5 Claims, 1 Drawing Sheet

(51) Int. Cl.
*B21J 1/06* (2006.01)
*B21J 13/03* (2006.01)
*B21J 13/08* (2006.01)

(58) Field of Classification Search
USPC .. 72/342.7, 342.8, 342.92, 342.94, 360, 470
See application file for complete search history.

(56) References Cited

U.S. PATENT DOCUMENTS

| | | | | |
|---|---|---|---|---|
| 2008/0295927 | A1 | 12/2008 | Cichocki et al. | |
| 2011/0259074 | A1* | 10/2011 | Ito | B21J 1/06 72/342.92 |
| 2013/0160511 | A1 | 6/2013 | Huang | |

FOREIGN PATENT DOCUMENTS

| | | | |
|---|---|---|---|
| JP | H08-206768 | A | 8/1996 |
| JP | H11-033663 | A | 2/1999 |
| JP | H11-077214 | A | 3/1999 |
| JP | 2001-225139 | A | 8/2001 |
| JP | 2003-103331 | A | 4/2003 |
| JP | 2004-337935 | A | 12/2004 |
| JP | 2009-000694 | A | 1/2009 |
| JP | 2010-531230 | A | 9/2010 |
| JP | 2011-031285 | A | 2/2011 |

OTHER PUBLICATIONS

JPO Machine Translation of JP 03-077741.*
International Search Report; PCT/JP2013/058920; Jul. 2, 2013.
Written Opinion of the International Searching Authority; PCT/JP2013/058920; Jul. 2, 2013.
The extended European search report issued by the European Patent Office on Jan. 8, 2016, which corresponds to European Patent Application No. 13769430.3-1702 and is related to U.S. Appl. No. 14/375,958.

* cited by examiner

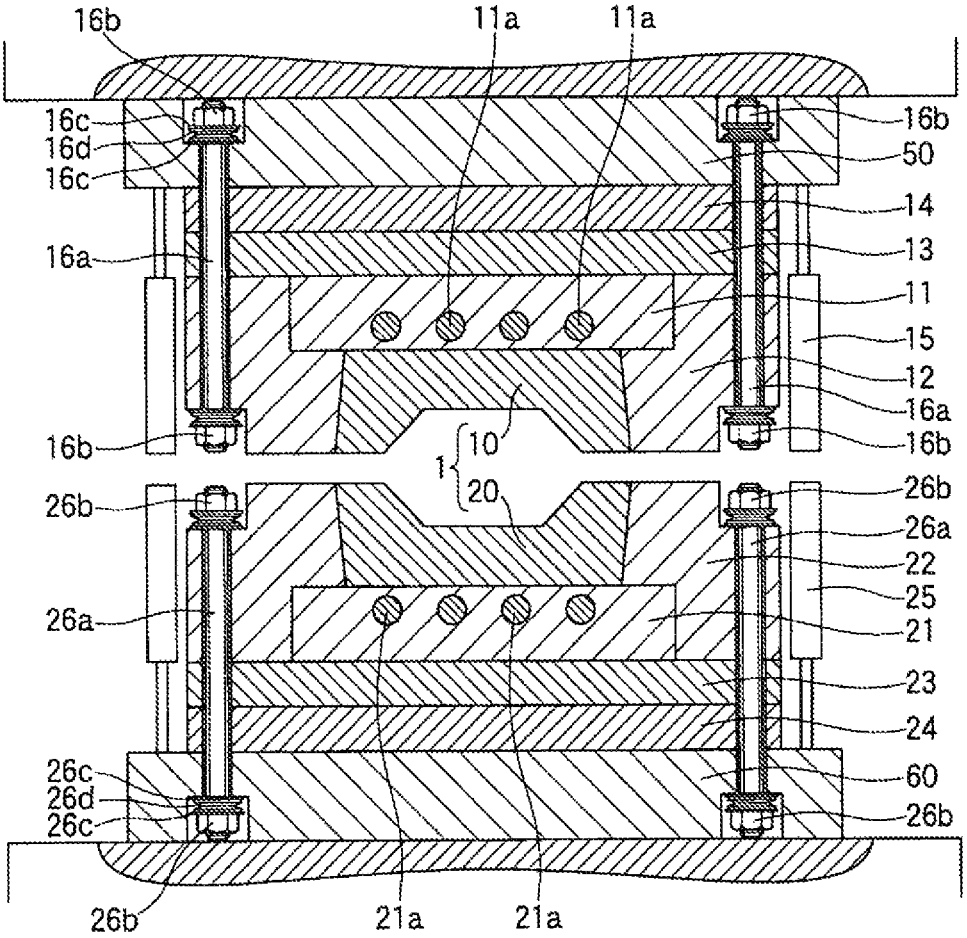
16b
11a
11a
16c
16d
16c
16b
50
14
16a
13
11
15
12
16a
16b
10
1
20
16b
26b
26b
26a
22
25
26a
21
23
24
26c
26d
26c
60
26b
26b
21a
21a

FORGING DIE DEVICE

TECHNICAL FIELD

The present invention relates to a forging die device used for high-temperature forging (hot forging) of hardly workable metal materials such as titanium alloy and Ni-based alloy.

BACKGROUND ART

In recent years, dies are increasingly used for the high-temperature forging of hardly workable metal materials such as titanium alloy and Ni-based alloy. In a forging die device conventionally provided in a forging press apparatus for high-temperature forging, for example, a plurality of heater insert holes are formed in each of an upper die and a lower die. The upper die and the lower die are heated by rod-shaped sheath heaters (called also "cartridge heaters") inserted respectively to the heater insert holes. This type of forging die devices is shown, for example, in Patent Documents 1 and 2.

CITATION LIST

Patent Document

Patent Document 1: JP 2004-337935 A (paragraph [0032], FIG. 3)

Patent Document 2: JP 11-77214 A (paragraph [0010], FIG. 2)

SUMMARY OF THE INVENTION

Technical Problem

However, in the above-mentioned conventional forging die device, it is difficult to miniaturize the die itself since the strength of the die must be secured even in such a structure provided with a plurality of heater insert holes. A die with built-in sheath heaters must be prepared for each of various forged products differed in size and the like. Further, it is difficult to reduce the price of the forging die device since the die is made of a heat resistant alloy or the like that is expensive in material cost.

An object of the present invention is thus to provide a forging die device used for high-temperature forging of forging materials, capable of miniaturizing a die, and sharing a die holder for a plurality of types of forged products differed in size and the like.

Solution to Problem

To solve the above-mentioned problems, the present invention has the following technical means.

A forging die device of the present invention is a forging die device used for high-temperature forging of a forging material, which is provided with an upper die and a lower die, in which at least one die of the upper die and lower die has a die holder which surrounds the outer periphery of the die and holds the die.

Preferably, this forging die device includes a die heating unit provided separately from at least the one die of the upper die and lower die, and the die heating unit heats at least the one die of the upper die and lower die, which is held by the die holder.

In this forging die device, preferably, the die heating unit is a heater plate with a plurality of built-in sheath heaters, and the heater plate is disposed in such a manner that it abuts on a surface opposite to a product forming surface of at least the one die of the upper die and lower die.

This forging die device preferably includes a die holder heating means for heating the die holder.

In this forging die device, the die holder heating means is preferably an infrared heater.

Effect of the Invention

In the forging die device of the present invention, with respect to at least one die of the upper and lower dies, the die holder which surrounds the outer periphery of the die and holds the die is provided, so that the radial tensile stress (tensile force) received by the die during forging is born by the die holder. By this means, the die can be miniaturized. This enables a reduction in price of the die made of an expensive material, for example, Ni-based heat resistant alloy. Since the die holder is configured to surround the outer periphery of the die, the die holder can be shared, so that only the replacement of the die suffices for a plurality of types of forged products differed in size, thickness and the like. Accordingly, the productivity can be improved.

BRIEF DESCRIPTION OF DRAWINGS

The FIGURE is a cross-sectional view schematically showing the configuration of a forging die device according to one embodiment of the present invention.

DESCRIPTION OF EMBODIMENTS

Embodiments of the present invention will be then described in reference to the drawing. The FIGURE is a cross-sectional view schematically showing the configuration of a forging die device according to one embodiment of the present invention.

As shown in the FIGURE, a die 1 is composed of an upper die 10 and a lower die 20.

The upper die 10 side is described first. The upper die side of the forging die device includes, as shown in the FIGURE, the upper die 10, a die plate 14 which supports the upper die 10, a die holder 12, a heater plate 11 with a plurality of built-in sheath heaters 11*a*, and a heat insulating plate 13. The die holder 12 surrounds the outer periphery of the upper die 10 and holds the upper die 10. The heater plate 11 functions as a die heating means for heating the upper die 10 held by the die holder 12, and is disposed in such a manner that it abuts on a surface opposite to a product forming surface of the upper die 10. The heat insulating plate 13 is disposed between the heater plate 11 and the die plate 14. An infrared heater 15 functions as a die holder heating means for heating (radiation-heating) the die holder 12. In forging, the upper die 10 preheated by a heating furnace is fitted to the inside of the die holder 12, and fixed to the die holder 12 by use of, for example, pins not shown or the like. In this way, the upper die side of the forging die device has a so-called "nested structure".

A base plate 50 is fixed to a lifting and lowering-side member (slider) of a pressing machine not shown. Prior to the installation of the preheated upper die 10, the die plate 14, the heat insulating plate 13, the heater plate 11 and the die holder 12 are mounted on the base plate 50 in an integrated manner by use of tie rods 16*a*, nuts 16*b*, washers 16*c*, and disc springs 16*d*. The infrared heater 15 is supported by the base plate 50.

The lower die 20 side is then described. The lower die side of the forging die device includes, as shown in the FIGURE, the lower die 20, a die plate 24 which supports the lower die 20, a die holder 22, a heater plate 21 with a plurality of built-in sheath heaters 21*a*, a heat insulating plate 23, and an infrared heater 25. The die holder 22 surrounds the outer periphery of the lower die 20 and holds the lower die 20. The heater plate 21 functions as a die heating means for heating the lower die 20 held by the die holder 22, and is disposed in such a manner that it abuts on a surface opposite to a product forming surface of the lower die 20. The heat insulating plate 23 is disposed between the heater plate 21 and the die plate 24. The infrared heater 25 functions as a die holder heating means for heating (radiation-heating) the die holder 22. In forging, the lower die 20 preheated by the heating furnace is fitted to the inside of the die holder 22, and fixed to the die holder 22 by use of, for example, pins not shown or the like. In this way, the lower die side of the forging die device has a so-called "nested structure".

A base plate 60 is fixed to a fixed-side member (bolster) of the pressing machine. Prior to the installation of the preheated lower die 20, the die plate 24, the heat insulating plate 23, the heater plate 21 and the die holder 22 are mounted on the base plate 60 in an integrated manner by use of tie rods 26*a*, nuts 26*b*, washers 26*c* and disc springs 26*d*. The infrared heater 25 is supported by the base plate 60. In the FIGURE, a knock-out mechanism for ejecting a forged product and the like are not shown.

In this embodiment, the upper and lower dies 10, 20 are formed in a disk shape having a product forming surface, and made of, for example, Ni-based heat resistant alloy. The heater plates 11, 21 are formed in a disk shape and made of, for example, Ni-based heat resistant alloy. The die holders 12, 22 are formed in an annular shape and made of, for example, hot work tool steel. The heat insulating plates 13, 23 are formed in a disk shape and made of, for example, refractory brick. The die plates 14, 24 are formed in a disk shape and made of, for example, carbon steel.

In the thus-constituted forging die device, the upper die 10 is preheated to a predetermined temperature by the heating furnace and then guided to the pressing machine not shown. The upper die 10 is fitted to the inside of the die holder 12 in such a manner that its surface opposite to the product forming surface (the reverse side of the die) abuts on the heater plate 11, and fixed to the die holder 12 by use of, for example, pins not shown or the like. Prior to the installation of the upper die 10, the heater plate 11 and the die holder 12 are heated to a predetermined temperature (for example, a temperature about several hundreds degrees lower than a final target temperature of the upper die 10) respectively by the sheath heaters 11*a* and the infrared heater 15.

Similarly, the lower die 20 is preheated to a predetermined temperature by the heating furnace and then guided to the pressing machine not shown. The lower die 20 is fitted to the inside of the die holder 22 in such a manner that its surface opposite to the product forming surface (the reverse side of the die) abuts on the heater plate 21, and fixed to the die holder 22 by use of, for example, pins not shown or the like. Prior to the installation of the lower die 20, the heater plate 21 and the die holder 22 are heated to a predetermined temperature (for example, a temperature about several hundreds degrees lower than a final target temperature of the lower die 20) respectively by the sheath heaters 21*a* and the infrared heater 25.

The temperature of the upper die 10 (the product forming surface temperature of the upper die 10) is adjusted so as to be kept at the final target temperature by adjusting the outputs of the sheath heaters 11 and infrared heater 15. The temperature of the lower die 20 (the product forming surface temperature of the lower die 20) is adjusted so as to be kept at the final target temperature by adjusting the outputs of the sheath heaters 21 and the infrared heater 25. The dies 10, 20 are in contact with the die holders 12, 22 with zero clearance by thermally expanding in an elastically deformable range by heating. The die holders 12, 22 can be accurately temperature-adjusted in a non-contact manner by using the infrared heaters 15, 25.

The forging material composed of titanium alloy, Ni-based alloy or the like, that is a hardly workable metal material, is placed on the product forming surface of the lower die 20 after heated to the predetermined temperature by the heating furnace. In this way, high-temperature forging of the forging material is performed. The transfer of heat from the high-temperature side such as the heater plate 11 toward the die plate 14 and the base plate 50 is prevented by the heat insulating plate 13, and the transfer of heat from the high-temperature side such as the heater plate 21 toward the die plate 24 and the base plate 60 is similarly prevented by the heat insulating plate 23.

In this way, in the forging die device of this embodiment, with respect to each of the upper and lower dies 10, 20, the heater plates 11, 12 are provided separately from the dies 10, 20. Therefore, it is not necessary to provide a die having heater insert holes. In the die forging device of this embodiment, further, the die holders 12, 22 are provided so as to surround the outer peripheries of the dies 10, 20 and hold the dies 10, 20 respectively. Therefore, the radial tensile stress (tensile force) received by the dies 10, 20 during forging can be born by the die holders 12, 22. According to the forging die device of this embodiment, such configurations enable the miniaturization of the dies 10, 20. Consequently, the price of the dies 10, 20 composed of an expensive material such as Ni-based heat resistant alloy can be reduced.

The miniaturization of the dies 10, 20 further enables a reduction in the heating-up time of the dies 10, 20 by the heater plates 11, 21. Since the die holders 12, 22 are configured to surround the outer periphery of the dies 10, 20, the die holders 12, 22 can be shared, so that only the replacement of the dies 10, 20 suffices for a plurality of types of forged products differed in size, thickness and the like. Such configuration enables an improvement in the productivity.

In the above-mentioned embodiment, the upper and lower dies 10, 20 are shown in the same shape and size as one example thereof in the FIGURE. In accordance with this, the die holders 12, 22, the infrared heaters 15, 25, the heater plates 11, 21 and the like are also shown in the same shapes and sizes. However, the present invention is not limited thereto, and a forging die device provided with upper and lower dies differed in shape and size can be also applied naturally.

The forging die device of the above-mentioned embodiment is provided with, in addition to the die holder 12 which surrounds the outer periphery of the upper die 10 and holds the upper die 10, the die holder 22 which surrounds the outer periphery of the lower die 20 and holds the lower die 20. However, the forging die device according to the present invention may be provided with, with respect to the upper die 10 or the lower die 20, a die holder which surrounds the outer periphery of the die and holds the die.

Having described each embodiment of the present invention, the present invention is never limited to the above-mentioned embodiments, and various changes and modifications of the present invention can be made without departing from the scope of the claims. The present application is based on Japanese Patent Application (Application No. 2012-073850) which was filed on Mar. 28, 2012, and the content thereof is embraced herein as reference.

EXPLANATION OF REFERENCE NUMERALS

1 Die
10 Upper die
20 Lower die
11, 21 Heater plate
11*a*, 21*a* Sheath heater
12, 22 Die holder
13, 23 Heat insulating plate
14, 24 Die plate
15, 25 Infrared heater
50, 60 Base plate

The invention claimed is:

1. A forging die device used for high-temperature forging of a forging material, comprising:

an upper die and a lower die configured to be brought together to forge the forging material between forming surfaces of the upper and lower dies;

an upper die holder which surrounds an outer periphery of the upper die and holds the upper die in place relative to the upper die holder;

a lower die holder which surrounds an outer periphery of the lower die and holds the lower die in place relative to the lower die holder;

a die heating unit configured to heat at least one of the upper die and the lower die;

an upper die holder heating unit surrounding the upper die holder for heating the upper die holder; and a lower die holder heating unit, provided separately from the upper die holder heating unit, which surrounds the lower die holder for heating the lower die holder, the upper and lower die holder heating units both being disposed in a non-contact manner relative to the upper and lower die holders and provided separately from the die heating unit.

2. The forging die device according to claim 1, wherein the die heating unit is provided separately from the at least one of the upper die and the lower die.

3. The forging die device according to claim 2, in which the die heating unit is a heater plate with a plurality of built-in sheath heaters; and the heater plate is disposed in such a manner that it abuts on a surface opposite to a product forming surface of the at least one of the upper die and the lower die.

4. The forging die device according to claim 1, in which at least one of the upper die holder heating unit and the lower die holder heating unit is an infrared heater.

5. The forging die device according to claim 1, wherein the upper die holder heating unit is aligned with the upper die holder and the lower die holder heating unit is aligned with the lower die holder.

* * * * *